US005555656A

United States Patent [19]

Liu

[11] Patent Number: 5,555,656

[45] Date of Patent: Sep. 17, 1996

[54] STRUCTURE OF CRYSTAL BALL PROVIDING DYNAMIC PHENOMENON IN THE BASE

[76] Inventor: Jian H. Liu, No. 3, Alley 202, Kao Fen Rd., Hsin-Chu City, Taiwan

[21] Appl. No.: 409,984

[22] Filed: Mar. 24, 1995

[51] Int. Cl.[6] ..... G09F 19/08

[52] U.S. Cl. ..... 40/411; 40/473; 40/410

[58] Field of Search ..... 40/406, 409, 410, 40/411, 414, 473; 446/243, 408; 84/94.1, 94.2, 95.1, 95.2

[56] References Cited

U.S. PATENT DOCUMENTS 3,594,934 7/1971 Burnbaum ..... 40/414 X
4,852,283 8/1989 Teng ..... 40/410 X
5,070,633 12/1991 Liu .
5,313,727 5/1994 Murray, Jr. ..... 40/410
5,456,031 10/1995 Hou ..... 40/410

*Primary Examiner*—Brian K. Green
*Attorney, Agent, or Firm*—Larson and Taylor

[57] ABSTRACT

The structure of crystal ball which can provide dynamic phenomenon in the base is disclosed. It includes a gear fixed on the driving axle of the music bell, the rotating pedestal on which the music bell is installed, and a controller engaged with the tenon of the chassis and located between the gear and the circumference of the rotating pedestal. When the driving axle of the music bell is rotated in a counterclockwise direction, the synchronous rotation of the rotating pedestal is limited by the controller. When the power of the spring of the music bell is released, the driving axle is limited by the controller to rotate in clockwise direction, then the rotating pedestal is driven to rotate in a counterclockwise direction by the music bell.

7 Claims, 6 Drawing Sheets

STRUCTURE OF CRYSTAL BALL PROVIDING DYNAMIC PHENOMENON IN THE BASE

BACKGROUND OF THE INVENTION

The present invention relates to a structure of crystal ball which can provide dynamic phenomenon in the base, the rotating pedestal in the base of the crystal ball being rotated by the power of the music bell.

DESCRIPTION OF THE PRIOR ART

In general, the dynamic phenomenon is occurred on the adornment inside the crystal ball for the conventional music bell the power source of which is the spring, and the dynamic phenomena are diversified.

The alternative design which is different from the foregoing one is disclosed in U.S. Pat. No. 5,070,633, for example, in which the base and the crystal ball are separated, and the driving axle of the music bell on the bottom of the crystal ball is connected with the foregoing base on the center, then the crystal ball is rotated thereby.

U.S. application Ser. No. 07/566,826 discloses another design providing different dynamic phenomena, in which a revolving disk is installed between the base and the crystal ball and also engaged with the gear of the music bell inside the base for being rotated.

SUMMARY OF THE INVENTION

The foregoing known designs of the crystal ball involve nothing about the dynamic phenomenon inside the base of the crystal ball which is the main subject discussed in this invention.

The structure inside the base of the crystal ball includes the gear fixed on the driving axle of the music bell, a rotating pedestal on which the music bell is installed, and a controller engaged with the tenon and located between the aforesaid gear and the circumference of the rotating pedestal. By the configuration described above, the rotating pedestal is rotated by the power of the music bell, then the dynamic phenomenon of rotation of it is observed from the windows formed on the base of the crystal ball.

DETAILED DESCRIPTION OF THE EMBODIMENTS

Figure 1:
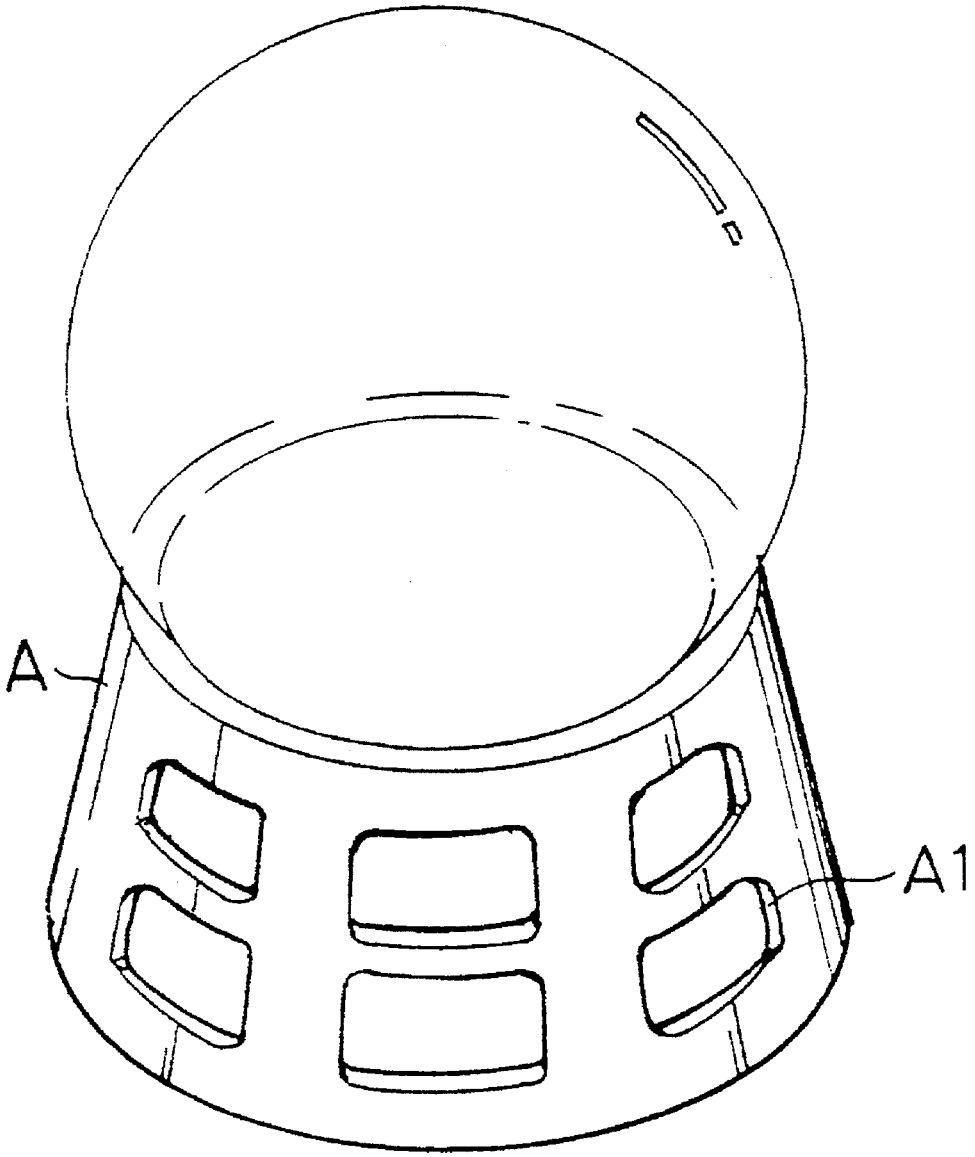
FIG. 1 is a perspective view of the whole crystal ball of this invention.

As shown in FIG. 1, a plurality of windows (A1) used for observing the inside of the base (A) are formed on the wall of the base (A), the internal structure (B) of the base (A) will be described hereinafter.

Figure 2:
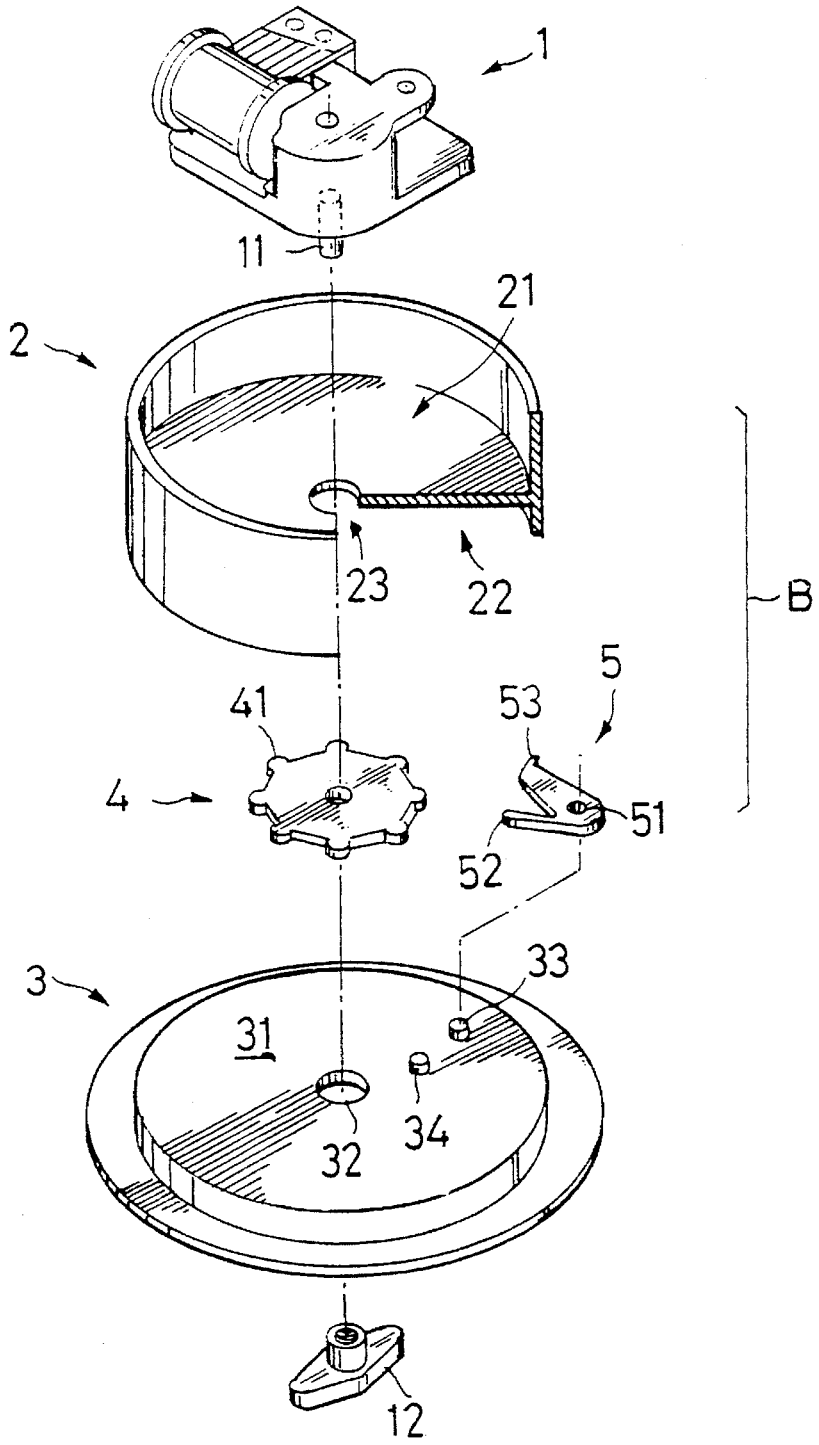
FIG. 2 is an exploded perspective view indicating the associated components inside the base of the ball.
Figure 3:
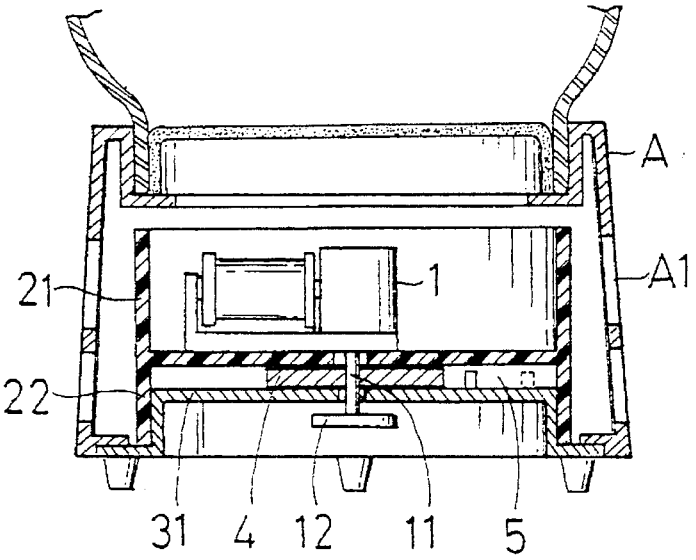
FIG. 3 is a vertical cross sectional view of the base.

The foregoing structure (B) includes a music bell (1), a rotating pedestal (2), a chassis (3), a gear (4), a controller (5), as shown in FIGS. 2 and 3. The music bell (1) is the one which uses the spring as the power source, a driving axle (11) used for winding up the spring is installed on the music bell (1), and it is extended downwards and connected with a revolving button or handle (12) on the end for conveniently winding the spring of the music bell (1) in a counterclockwise direction (from the specification of the music bell manufacturer), so the driving axle (11) is rotated in the clockwise direction when the power is released from the music bell (1).

Figure 4:
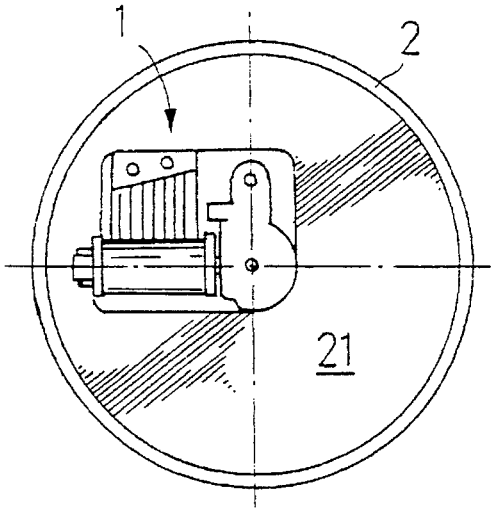
FIG. 4 is a top plan view showing the relative arrangement of the music bell and the rotating pedestal.

Moreover, a cylindrical rotating pedestal (2) composed of an upper concave part (21) and a lower concave part (22) is installed, the music bell (1) is located in and shielded by the upper concave part (21) of the rotating pedestal (2), and it is invisible from the windows (A1) outside the base, as shown in FIG. 4. The driving axle (11) is extended longitudinally and downwards through a central hole (23) in the rotating pedestal (2).

Besides, the chassis (3) is engaged with the base (A) on the bottom, a convex part (31) the diameter of which is slightly smaller than that of the lower concave part (22) is formed on the center of the chassis (3), thus the rotating pedestal (2) is rotated freely on the chassis (3) by the engagement between the lower concave part (22) and the convex part (31).

The concave depth of the lower concave part (22) is larger than the height of the convex part (31), so an interspace is formed between the lower concave part (22) and the convex part (31) when they are engaged with each other, and a gear (4) is installed in it.

The driving axle (11) penetrating the central hole (23) of the rotating pedestal is also extended through the gear (4) and the central hole (32) of the convex part (31), and a rotatable button or handle (12) used for winding up the spring of the music bell (1) is connected on the end thereof.

The aforesaid gear (4) is connected tightly with the driving axle (11) for synchronously rotating with the driving axle (11).

According to the aforedescribed configuration, the rotating pedestal (2) on which the music bell (1) is fixed is freely rotated, so if the synchronous rotation with the revolving button (12) is not stopped, the spring of the music bell (1) can not be wound when the operator rotates the revolving button (12) (in the counterclockwise direction).

For achieving the operation of winding the spring by restricting the synchronous rotation between the rotating pedestal (2) and the revolving button (12), a V shaped controller (5) is installed between the aforesaid gear (4) and the circumference of the lower concave part (22) of the rotating pedestal. Controller (5) includes a hook part (53) which can be engaged with teeth or barb (24) formed on the inner circumference of the lower concave part (22) is formed on one end of one arm of controller (22). The other arm of controller (5) is an elastic stick (52) with proper length. Moreover, an axial hole (51) of the controller is used to be engaged with a post or tenon (33) formed on the convex part (31) of the chassis, so the controller (5) can swing or oscillate, as shown in FIGS. 5 and 6.

Figure 5:
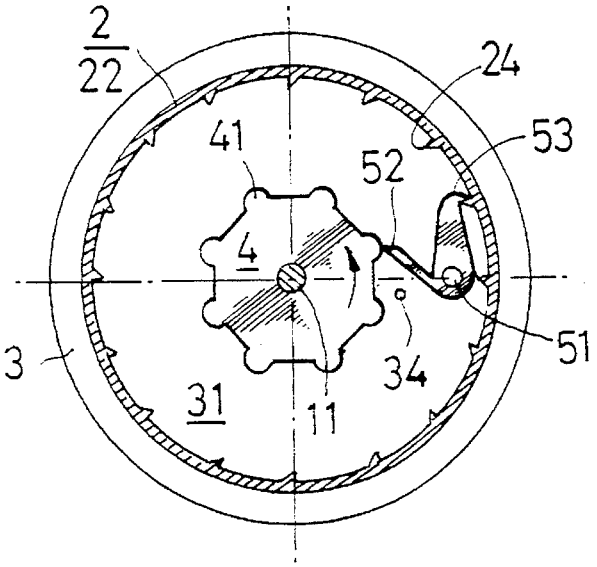
FIGS. 5 and 6 are horizontal cross sectional views of the rotating pedestal depicting the swinging state of the controller with respect to the rotating pedestal and the gear.
Figure 6:
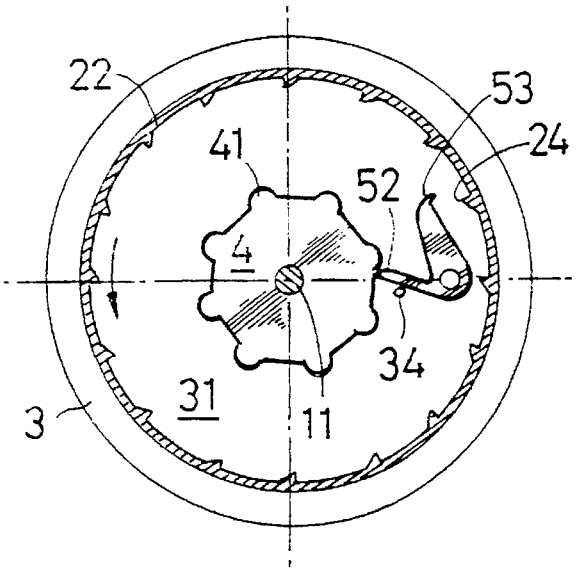

After the design of aforesaid controller (5) is understood, when the operator rotates the driving axle (11) by the revolving button (12) in counterclockwise direction for winding up the spring of the music bell (1), the gear (4), of course, is rotated synchronously, as shown in FIG. 5. Because the end of the aforesaid elastic stick (52) of the controller (5) is extended to the location between the teeth (41) of the gear (4), it is pushed by the teeth (41) when the gear (4) is rotated, and the controller (5) is rotated round the tenon (33) by an angle, then the hook part (53) of the controller (5) is moved to the area of the barb (24) on the lower concave part of the rotating pedestal and engaged with the barb (24) for stopping the counterclockwise rotation of the rotating pedestal (2), thus the operation of winding up the spring of the music bell (1) is possible.

When the hook part (53) of the aforementioned controller (5) is rotated to the location where it can be engaged with the barb (24), the end of the elastic stick (52) is continuously pushed by the teeth (41) of the rotating gear (4), then the elastic stick (52) is slightly bent by the teeth (41). When the elastic stick (52) is placed between the teeth (41), the bending elastic stick (52) is recovered to the straight state, thus the end of the elastic stick (52) is always placed between the teeth (41) of the gear (4).

When the rotating force to the revolving button (12) is removed, the power of the wound spring of the music bell (1) is released slowly, and the driving axle (11) starts to rotate in clockwise direction. Because the end of the elastic stick (52) is always placed between the teeth (41) of the gear (4), the rotating gear (4) can push the elastic stick (52) to rotate the controller (5), and then the limitation on the barb (24) of the rotating pedestal (2) from the hook part (53) is removed, as shown in FIG. 6. The elastic stick (52) is pushed to rotate until it contacts a stop or locating tenon (34) formed on the convex part (31) of the chassis, then the clockwise rotation of the gear (4) is stopped by it. Owing to the clockwise rotation of the gear (4) is stopped and the limitation on the barb (24) of the rotating pedestal (2) from the hook part is removed, the rotating pedestal (2) can perform a counterclockwise rotation.

If the adornment is added on the outer wall of the rotating pedestal (2) which is rotating, then the rotating phenomenon of it is observed from the windows (A1) on the base (A) of the crystal ball.

Figure 7:
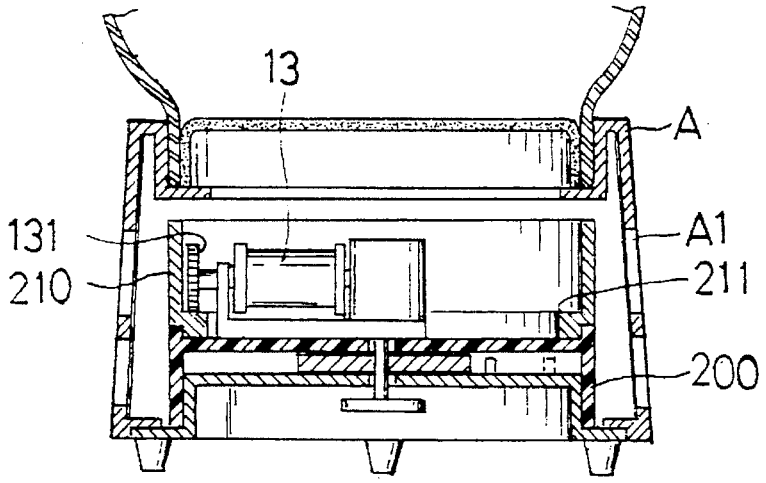
FIGS. 7 and 8 are, respectively, a vertical and a horizontal cross sectional views of alternative embodiments disclosing the two layers rotating pedestals with different rotating directions.
Figure 8:
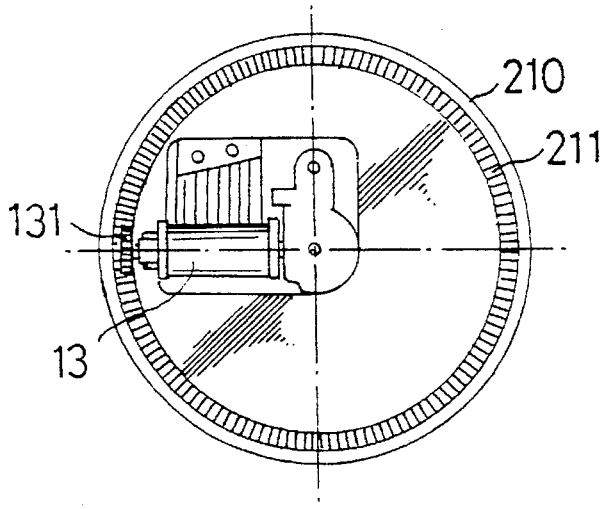

The rotating pedestal (2) of the foregoing embodiment is a single component of a whole wall, for performing more diversified change effect, FIGS. 7 and 8 are the alternative embodiments showing the new rotating pedestals (200, 210) which are two layers, wherein the arrangement between the rotating pedestal (200) and the music bell (1) or the controller (5) is unchanged, the rotating pedestal (210) is engaged on the top of the rotating pedestal (200), and an annular teeth (211) is formed on the bottom of the inner wall thereof.

Besides, a gear (131) which can be engaged with the annular teeth (211) of the rotating pedestal (210) is installed on the revolving axle (13) used to play the sounding-board of the music bell (1) for rotating the rotating pedestal (210), but the rotating directions of the rotating pedestals (210, 200) are opposite (the rotating direction of the revolving axle arranged laterally is set by the manufacturer of the music bell).

The rotation speed of the aforesaid rotating pedestal (210) is controlled by the diameter of the gear (131) of the music bell.

Figure 9:
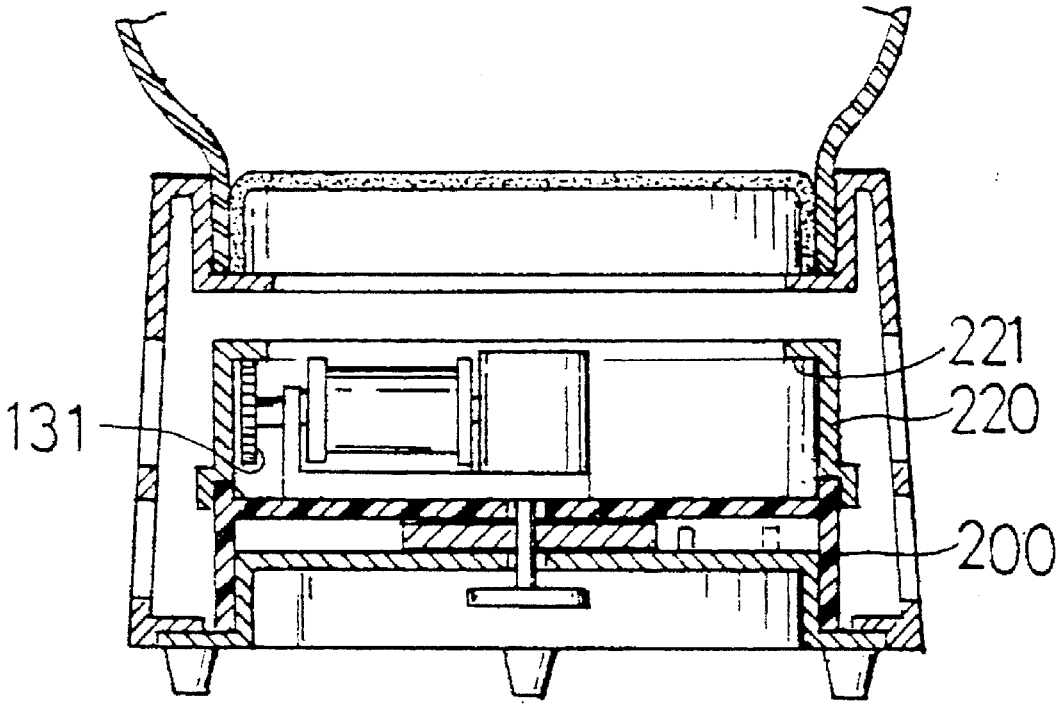
FIG. 9 is a vertical cross sectional view of another alternative embodiment disclosing the two layers rotating pedestals with the same rotating directions but different rotating speeds.

The alternative embodiment shown in FIG. 9 discloses the two layers rotating pedestals with more diversified change effect, the annular teeth (221) on the upper rotating pedestal (220) is formed on the top edge of the inner wall and engaged with the gear (131) of the music bell (1), then the rotating direction of the rotating pedestal (220) is the same with that of the rotating pedestal (220), and the rotating speed of the rotating pedestal (220) is twice as that of the rotating pedestal (220).

I claim:

1. In a decorative device having a base, a structure providing a dynamic phenomenon in the base and including a chassis having a platform with a central hole;

a stop mounted on said chassis platform;

a rotating pedestal having an axially extending, circumferential rim with teeth mounted thereon and having a platform with a central hole, said pedestal being mounted on said chassis such that said chassis platform and said pedestal platform are spaced apart;

a music bell fixed on said rotating pedestal platform, said music bell having a driving axle which extends through said central holes of said rotating pedestal and said chassis;

a gear having teeth and located in the space between said rotating pedestal platform and said chassis platform, and rigidly mounted on said driving axle of the music bell; and a controller having a first end portion and a second end portion and pivotally mounted between said gear and the teeth formed on the circumference of said rotating pedestal such that said controller can swing, said controller having hook portion which can engage said pedestal teeth, said hook portion being formed on said first end portion of said controller, the second end portion of said controller always being placed between the teeth of said gear such that said second end portion is pushed by said gear for moving said hook portion of said controller to engage with said teeth of said rotating pedestal; and such that when said controller is rotated for disengaging said hook portion from said teeth of said rotating pedestal, said second end portion can contact said stop of said chassis, and the reverse rotation of said gear is limited by said second end portion the rotation of which is stopped.

2. The structure as set forth in claim 1, wherein said second end portion of said controller is elastic.

3. The structure as set forth in claim 1, wherein an upper concave part is formed on said rotating pedestal for shielding said music bell, and a lower concave part has said pedestal teeth formed on the inner circumference thereof is also formed on said pedestal.

4. The structure as set forth in claim 1, wherein said chassis has a convex part formed on the center of said chassis, said convex part mounting said pedestal lower concave part.

5. The structure as set forth in claim 1, wherein a further rotating pedestal is mounted on the top of said rotating pedestal, said further rotating pedestal having a bottom and a wall at said bottom, said wall having an inner surface, and said further rotating pedestal having annular teeth formed on said inner surface;

and wherein said music bell has a laterally extending, revolving axle, and said annular teeth is engaged with the revolving axle.

6. The structure as set forth in claim 5, wherein said music bell laterally extending axle has a gear thereon; and wherein said inner surface has an upper edge and said annular teeth of the further rotating pedestal is formed on the upper edge of the inner surface, and said annular teeth is engaged with said gear installed on the end of said revolving axle arranged laterally of said music bell.

7. The structure as set forth in claim 1, wherein the base has a wall and a plurality of windows are formed on the wall of said base for permitting observation of the inside of said base from outside.

* * * * *